US009165515B2

(12) United States Patent
Kim et al.

(10) Patent No.: US 9,165,515 B2
(45) Date of Patent: Oct. 20, 2015

(54) LIQUID CRYSTAL DISPLAY DEVICE AND DRIVING METHOD THEREOF

(71) Applicant: LG Display Co., Ltd., Seoul (KR)

(72) Inventors: Jong Woo Kim, Gyeonggi-do (KR); Su Hyuk Jang, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/038,962

(22) Filed: Sep. 27, 2013

(65) Prior Publication Data

US 2014/0092070 A1 Apr. 3, 2014

(30) Foreign Application Priority Data

Sep. 28, 2012 (KR) ..... 10-2012-0108482

(51) Int. Cl.
*G09G 3/00* (2006.01)
*G09G 3/36* (2006.01)

(52) U.S. Cl.
CPC ..... *G09G 3/3614* (2013.01); *G09G 2310/0224* (2013.01); *G09G 2320/0204* (2013.01); *G09G 2320/0257* (2013.01); *G09G 2340/0435* (2013.01)

(58) Field of Classification Search
CPC combination set(s) only.
See application file for complete search history.

(56) References Cited

U.S. PATENT DOCUMENTS 5,861,863 A * 1/1999 Kudo et al. ..... 345/100
6,278,427 B1 * 8/2001 Matsumoto et al. ..... 345/88
2005/0156857 A1 7/2005 Lee et al.
2005/0195144 A1 9/2005 Kwon et al.
2008/0170024 A1 * 7/2008 Song et al. ..... 345/96
2008/0309656 A1 * 12/2008 Van Woudenberg et al. . 345/214
2010/0097366 A1 * 4/2010 Kitayama et al. ..... 345/213
2013/0141414 A1 * 6/2013 Park ..... 345/212

FOREIGN PATENT DOCUMENTS

CN 1652189 A 8/2005
CN 1661660 A 8/2005

OTHER PUBLICATIONS

Office Action dated Apr. 24, 2015, issued by the State Intellectual Property Office of China in Chinese Patent Application No. 201310450178.1.

* cited by examiner

*Primary Examiner* — Linh N Hoffner
(74) *Attorney, Agent, or Firm* — Morgan, Lewis & Bockius LLP

(57) ABSTRACT

A liquid crystal display (LCD) device and method of driving an LCD device are provided. The LCD device includes: a panel, including: a plurality of gate lines, and a plurality of data lines, an image-sticking removal apparatus configured to, when an interlaced input video is received from an external system: generate an FRC pattern to be added into the input video and a polarity pattern used to output the input video to form one group, and generate at least two or more the groups formed in parallel to the gate lines during one frame, and a data driver configured to: convert image data inputted from the image-sticking removal apparatus into data voltages, invert a polarity of each of the data voltages on the basis of the polarity pattern, and output the polarity-inverted data voltages to the respective data lines.

11 Claims, 10 Drawing Sheets

LIQUID CRYSTAL DISPLAY DEVICE AND DRIVING METHOD THEREOF

CROSS-REFERENCE TO RELATED APPLICATION(S)

This application claims the benefit under 35 U.S.C. §119 (a) of Korean Patent Application No. 10-2012-0108482, filed on Sep. 28, 2012, in the Korean Intellectual Property Office, the entire disclosure of which is incorporated by reference herein for all purposes.

BACKGROUND

1. Technical Field

The following description relates to a liquid crystal display (LCD) device, and more particularly, an LCD device and a driving method thereof which remove image sticking when a frame rate control (FRC) mode and an interlaced scan mode are used.

2. Discussion of the Related Art

With the advancement of various portable electronic devices, such as mobile phones, personal digital assistants (PDAs), notebook computers, etc., the demand for Flat Panel Display (FPD) devices applicable to the portable electronic devices is increasing. LCD devices, plasma display panels (PDPs), field emission display (FED) devices, and light emitting display devices are being actively researched as FPD devices.

In such FPD devices, LCD devices are devices that display an image using the optical anisotropy of liquid crystal. Since the LCD devices have a thin thickness, a small size, and low power consumption and realize a high-quality image, the LCD devices are widely used.

FIG. 1 illustrates charts for describing a state in which image sticking is caused by a polarity bias in accumulated frames, in a related art LCD device using an FRC mode and an interlaced scan mode in a related art device.

As methods of displaying an image, there are an interlaced scan mode (hereinafter, referred to as an "interlaced mode") and a progressive scan mode (hereinafter, referred to as a "progressive mode"). The interlaced mode, in which there is a small amount of data, has been widely used, but, recently, the progressive mode is also being used more widely.

The FRC mode is a mode that reduces the number of bits of data to decrease the number of data transfer lines, and compensates for a degradation of an image quality, and is being applied to most LCD devices.

One Advanced High Performance In-Plane Switching (AH-IPS) mode is called "a fringe field switching" (FFS) mode. In the AH-IPS mode, a pixel electrode and a common electrode are formed to be separated from each other with an insulating layer therebetween. In LCD devices using the AH-IPS mode, one electrode is formed in a plate shape, the other electrode is formed in a finger shape, and an alignment of a liquid crystal layer is adjusted with a fringe field generated between the two electrodes.

In LCD devices that receive input video (generated in the interlaced mode) from an external system to output an image through a panel in the interlaced mode, image sticking is caused by the use of the interlaced mode. The image sticking excessively occurs in LCD devices driven in the AH-IPS mode. To solve this problem, various methods for removing the image sticking caused by the use of the interlaced mode are being researched and developed.

Moreover, even in the LCD devices that output an image by using the FRC mode, image sticking caused by the FRC mode occurs. The image sticking excessively occurs in the LCD devices driven in the AH-IPS mode. To solve this problem, various methods for removing the image sticking caused by the use of the interlaced mode are being researched and developed.

However, in LCD devices using both the interlaced mode and the FRC mode, image sticking caused by the interlaced mode and the FRC mode differs from image sticking occurring in LCD devices to which the interlaced mode and the FRC mode are applied separately from each other.

Therefore, even though there are a method for solving image sticking in the interlaced mode and a method for solving image sticking in the FRC mode, a method which is implemented by simply combining the two methods cannot remove image sticking occurring in the LCD devices using both the interlaced mode and the FRC mode.

The image sticking occurring in the LCD devices using both the interlaced mode and the FRC mode can occur due to various causes, and particularly, a polarity bias in accumulated frames is known as a severe cause of image sticking.

The reason that the image sticking is caused by a polarity bias in the LCD devices using both the interlaced mode and the FRC mode will now be described with reference to FIG. 1. In FIG. 1, a first line (X) indicates input images inputted as first to fourth frames in the interlaced mode, a second line (Y) indicates FRC patterns which are repeated in units of four frames, and a third line (Z) indicates panel polarities of the first to fourth frames.

A method of calculating a polarity bias in each of a plurality of pixels of a panel is expressed as the following Equation (1):

$$\begin{aligned}\text{polarity} = {} & (\text{input image of first frame} \times FRC\ \text{pattern} \times \text{panel polarity}) + \\ & (\text{input image of second frame} \times FRC\ \text{pattern} \times \text{panel polarity}) + \\ & (\text{input image of third frame} \times FRC\ \text{pattern} \times \text{panel polarity}) + \\ & (\text{input image of fourth frame} \times FRC\ \text{pattern} \times \text{panel polarity})\end{aligned} \tag{1}$$

A polarity of a first pixel P1 of the panel of FIG. 1 which is calculated through Equation (1) is expressed as Equation (2):

$$\text{polarity}=(1*0*(+1))+(0*0*(-1))+(1*1*(+1))+(0*0*(-1))=1 \tag{2}$$

That is, a case in which there is an input image is set to 1, a case in which there is no input image is set to 0, black in the FRC pattern is set to 0, white in the FRC pattern is set to 1, a case in which a panel polarity is negative (−) is set to −1, and a case in which a panel polarity is positive (+) is set to +1.

First, in a first pixel of the first frame, an input image is 1, the FRC pattern is 0, and a panel polarity is +1, whereby a total polarity value becomes 0.

In a first pixel of the second frame, an input image is 0, the FRC pattern is 0, and a panel polarity is −1, whereby a total polarity value becomes 0.

In a first pixel of the third frame, an input image is 1, the FRC pattern is 1, and a panel polarity is +1, whereby a total polarity value becomes 1.

In a first pixel of the fourth frame, an input image is 0, the FRC pattern is 0, and a panel polarity is −1, whereby a total polarity value becomes 0.

Therefore, a polarity of the first pixel P during the four frames becomes 1 (=0+0+1+0).

A polarity of a second pixel P2 of the panel which is calculated according to Equation (1) and the above-described method becomes 0 as expressed in Equation (3).

$$\text{polarity}=(1*0*(+1))+(0*0*(-1))+(1*1*(+1))+(0*0*(-1))=1 \tag{3}$$

Polarities of all pixels which are checked by the above-described method are as illustrated in a portion (S) of FIG. 1.

That is, in the LCD devices using both the interlaced mode and the FRC mode, a polarity bias of +1 or −1 occurs in units of four frames. Such a polarity bias continuously occurs despite a frame being continued.

When the above-described polarity bias occurs, image sticking can be caused by a deterioration of the panel, and for this reason, a quality of an LCD device can be degraded.

SUMMARY

Accordingly, embodiments of the present application are directed to a touch display device and method of manufacturing the same that substantially obviates one or more of problems due to the limitations and disadvantages of the related art.

An object of embodiments is to provide a touch display device where increase in thickness and fabrication cost and reduction in transmittance are prevented by changing the structure thereof.

Advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose according to one aspect of the invention, there is provided an LCD device, including: a panel, including: a plurality of gate lines, and a plurality of data lines, an image-sticking removal apparatus configured to, when an interlaced input video is received from an external system: generate an FRC pattern to be added into the input video and a polarity pattern used to output the input video to form one group, and generate at least two or more the groups formed in parallel to the gate lines during one frame, and a data driver configured to: convert image data inputted from the image-sticking removal apparatus into data voltages, invert a polarity of each of the data voltages on the basis of the polarity pattern, and output the polarity-inverted data voltages to the respective data lines.

In another aspect, there is provided a method of driving an LCD device, the method including: in response to an interlaced input video being received from an external system, by an image-sticking removal apparatus: generating an FRC pattern to be added into the input video and a polarity pattern used to output the input video to form one group, and generating at least two or more groups formed in parallel to gate lines of a panel during one frame, converting, by the image-sticking removal apparatus, the input video based on the FRC pattern to generate the image data, generating, by the image-sticking removal apparatus, a polarity signal corresponding to the polarity pattern, transferring, by the image-sticking removal apparatus, the image data and the polarity signal to a data driver, converting, by the data driver, the image data into data voltages, inverting, by the data driver, a polarity of each of the data voltages according to the polarity signal, and outputting, by the data driver, the polarity-inverted data voltages to respective data lines of the panel.

It is to be understood that both the foregoing general description and the following detailed description are examples and explanatory and are intended to provide further explanation of embodiments of the invention as claimed.

BRIEF DESCRIPTION OF THE DRAWINGS

The accompanying drawings, which are included to provide a further understanding of the invention and are incorporated in and constitute a part of this specification, illustrate implementations of the invention and together with the description serve to explain the principles of the invention.

Figure 1:
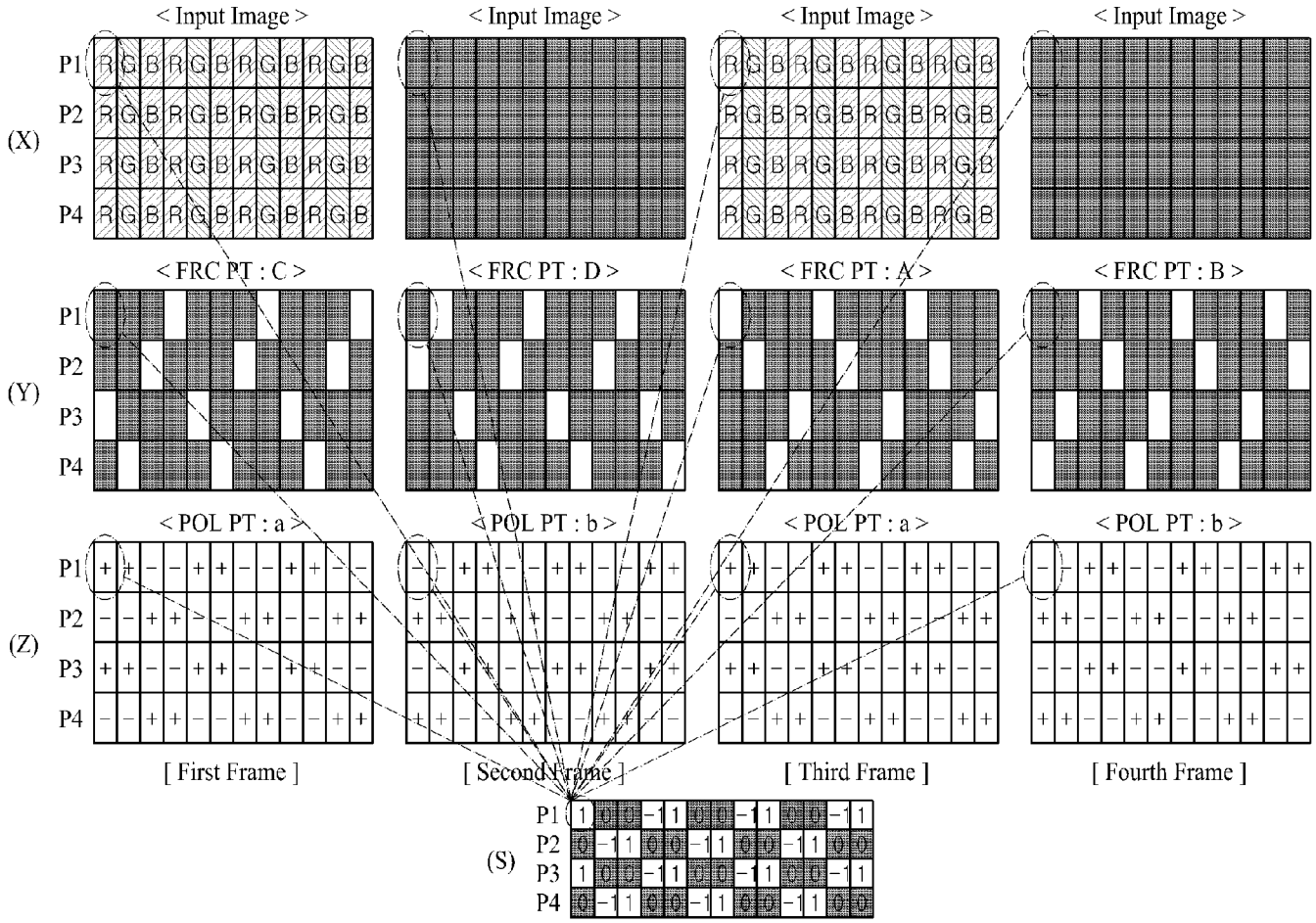
FIG. 1 Related Art
FIG. 1 illustrates charts for describing a state in which image sticking is caused by a polarity bias in accumulated frames, in a related art LCD device using an FRC mode and an interlaced scan mode.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION OF THE INVENTION

Reference will now be made in detail to embodiments of the present invention, examples of which are illustrated in the accompanying drawings. In the following description, when a detailed description of well-known functions or configurations related to this document is determined to unnecessarily cloud a gist of the invention, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a certain order. Like reference numerals designate like elements throughout. Names of the respective elements used in the following explanations are selected only for convenience of writing the specification and may be thus different from those used in actual products.

In the description of embodiments, when a structure is described as being positioned "on or above" or "under or below" another structure, this description should be construed as including a case in which the structures contact each other as well as a case in which a third structure is disposed therebetween.

Hereinafter, embodiments will be described in detail with reference to the accompanying drawings.

Figure 2:
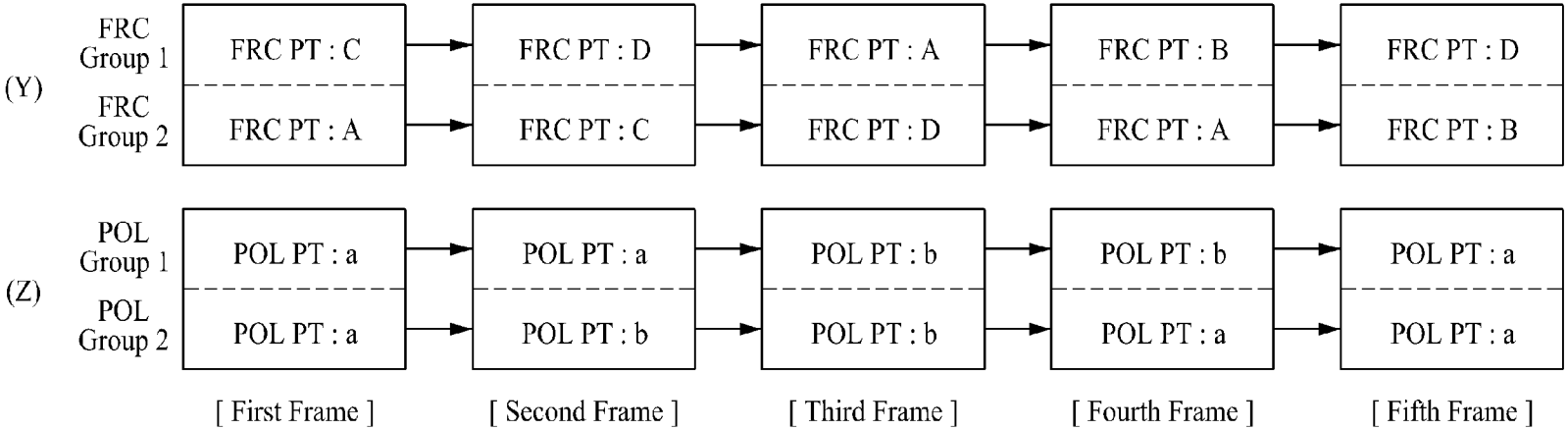
FIG. 2 illustrates flow diagrams for describing a state in which an FRC pattern and a polarity pattern are changed by an LCD device and a driving method thereof according to an embodiment.

FIG. 2 illustrates flow diagrams for describing a state in which an FRC pattern and a polarity pattern are changed by an LCD device and a driving method thereof according to an embodiment.

Embodiments relate to an LCD device and a driving method thereof which remove image sticking occurring when an interlaced mode and an FRC mode are used, in an AH-IPS mode.

Among the modes, the interlaced mode is a mode that is used from a time when an analog mode is used, and, for example, is a mode that captures about thirty images per second, divides each of the captured thirty images into two images to generate sixty images, and combines the divided two images to display thirty images. That is, the interlaced mode captures thirty images per second to generate thirty frames in capture, but in record, the interlaced mode divides each of the thirty frames into two frames to record sixty frames. When a television reproduces the frames, the television combines the divided two images to display thirty images.

The FRC mode is a mode that reduces the number of bits of data to decrease the number of data transfer lines, and compensates for a degradation of an image quality, and is currently applied to most LCD devices. The FRC mode reduces the number of bits of digital image data inputted to a source driving integrated circuit (IC) of a data driver, and increases the number of gray scales expressible with an FRC pattern, thus compensating for a loss.

As described above with respect to the background art, when both the interlaced mode and the FRC mode are applied to an LCD device, a polarity bias occurs in each of a plurality of pixels at certain-frame intervals, for example, at four-frame intervals. Such a polarity bias degenerates a panel, causing image sticking. As a result of a test for each mode applicable to LCD devices, image sticking caused by the polarity bias much occurs in, especially, the AH-IPS mode.

To solve such problems, as illustrated in FIG. 2, embodiments may jump a polarity pattern (POL PT) at predetermined-frame intervals, and may jump, e.g., skip, an FRC pattern (FRC PT) at other predetermined-frame intervals, thus removing image sticking caused by a polarity bias which may occur when the interlaced mode and the FRC mode are used. Embodiments may remove image sticking caused by a polarity bias which may excessively occur in the AH-IPS mode, but are not limited to the AH-IPS mode. It should be understood that the terms "jump" and "skip" may be used interchangeably.

First, as shown in the example of Table 1 below, the embodiments may jump the FRC pattern (FRC PT) at predetermined-frame intervals to output the jumped FRC pattern.

TABLE 1

| |
|---|
| C → D → A → B → // D → A → B → C → // A → B . . . |

For example, when there are four FRC patterns (C, D, A, and B), as shown in Table 1, the four FRC patterns may be sequentially changed in the order of C, D, A, and B up to a fourth frame, and when the fourth frame is changed to a fifth frame, the "D" FRC pattern instead of the "C" FRC pattern may be outputted.

The "C" FRC pattern may be outputted after the "B" FRC pattern of the fourth frame, but embodiments may jump, e.g., skip, the "C" FRC pattern to output the "D" FRC pattern. That is, in Table 1, the FRC patterns may be jumped at four-frame intervals and outputted.

Embodiments are not limited to the four-frame interval, and a frame interval may be variously changed. For example, when a polarity pattern (POL PT) to be described below is changed at 2n-frame intervals, the FRC patterns may be jumped at 2n×2m-frame intervals. Here, n is a natural number equal to or greater than one, and m is a natural number equal to or greater than one.

Second, as shown in the Table 2 example, embodiments may jump the polarity pattern (POL PT) at other predetermined-frame intervals to output the jumped FRC pattern. In the following description, the polarity pattern (POL PT) may be a set of polarity signals (POL) for image data which may be outputted through the panel during one frame. That is, the polarity pattern may indicate a polarity of a data voltage (corresponding to each of the image data which may be outputted through the panel during one frame) for each pixel.

TABLE 2

| |
|---|
| a → a → // b → b → // a → a → // b → b → . . . |

For example, when there are two polarity patterns ("a" and "b"), as shown in the Table 2 example, one of the two polarity patterns may be successively outputted in the order of "a" and "a" up to a second frame, and when the second frame is changed to a third frame, the "b" polarity pattern instead of the "a" polarity pattern may be outputted.

Generally, to reduce a deterioration of liquid crystal and image sticking, LCD devices periodically invert a polarity of a data voltage of each image signal to be outputted to the panel. As methods of driving the LCD device, there are: a frame inversion system, a column inversion system, a line inversion system, a dot inversion system, etc. A related art LCD device using the above-described driving method repeats one inversion system in units of one frame.

However, as described above, embodiments may change two different polarity patterns at predetermined-frame intervals, and thus may remove image sticking caused by a polarity bias which may occur in LCD devices using both the interlaced mode and the FRC mode. An inversion system applied to an embodiment may be one of the above-discussed inversion systems.

For example, a jumping period of the polarity pattern and a jumping period of the FRC pattern may be as described above. That is, when the polarity pattern (POL PT) is changed at 2n-frame intervals, the FRC pattern may be jumped at 2n×2m-frame intervals. Here, n is a natural number equal to or greater than one, and m is a natural number equal to or greater than one.

Third, in some embodiments, a combination of the FRC pattern and the polarity pattern may be provided in plurality in parallel to a plurality of gate lines formed in the panel. For example, as illustrated in FIG. 2, in an embodiment, each of the FRC pattern and the polarity pattern may be divided into a first group (Group 1) and a second group (Group 2) in a vertical direction of the panel (a liquid crystal panel) and driven.

However, the number of groups is not required to be two, and may be variously set in consideration of a size of the panel, the number of gate lines, the number of lengthwise FRC patterns, etc. Hereinafter, for convenience of description, as illustrated in FIG. 2, an example in which each of the FRC pattern and the polarity pattern may be set and used as two groups will be described.

For example, each of the first and second groups may be a combination of the FRC pattern and the polarity pattern. That is, in the FIG. 2 example, the first group outputted in an upper direction of the panel may be composed of a plurality of FRC patterns, which may be jumped at four-frame intervals in the order of C, D, A, B, and D; and a plurality of polarity patterns which are jumped at two-frame intervals in the order of a, b, b, a, and a.

For convenience of description, in FIG. 2, the FRC pattern and the polarity pattern composing one group are illustrated separately.

That is, a change of the FRC pattern (FRC PT) in the first group and a change of the FRC pattern (FRC PT) in the second group are illustrated in a portion (Y) of the FIG. 2 example, and a change of the polarity pattern (POL PT) in the first group and a change of the polarity pattern (POL PT) in the second group are illustrated in a portion (Z) of the FIG. 2 example.

To provide an additional description, during the first frame, an image based on the first group including the "C" FRC pattern (FRC PT: C) and the "a" polarity pattern (POL PT: a) may be outputted through an upper portion of the panel, and an image based on the second group including the "A" FRC pattern (FRC PT: A) and the "b" polarity pattern (POL PT: b) may be outputted through a lower portion of the panel.

During the second frame, an image based on the first group including the "D" FRC pattern (FRC PT: D) and the "a" polarity pattern (POL PT: a) may be outputted through the upper portion of the panel, and an image based on the second group including the "C" FRC pattern (FRC PT: C) and the "b" polarity pattern (POL PT: b) may be outputted through the lower portion of the panel.

During the third frame, an image based on the first group including the "A" FRC pattern (FRC PT: A) and the "b" polarity pattern (POL PT: b) may be outputted through the upper portion of the panel, and an image based on the second group including the "D" FRC pattern (FRC PT: D) and the "b" polarity pattern (POL PT: b) may be outputted through the lower portion of the panel.

During the fourth frame, an image based on the first group including the "B" FRC pattern (FRC PT: B) and the "b" polarity pattern (POL PT: b) may be outputted through the upper portion of the panel, and an image based on the second group including the "A" FRC pattern (FRC PT: A) and the "a" polarity pattern (POL PT: a) may be outputted through the lower portion of the panel.

During the fifth frame, an image based on the first group including the "D" FRC pattern (FRC PT: D) and the "a" polarity pattern (POL PT: a) may be outputted through the upper portion of the panel, and an image based on the second group including the "B" FRC pattern (FRC PT: B) and the "a" polarity pattern (POL PT: a) may be outputted through the lower portion of the panel.

That is, the FRC patterns (FRC Group 1) of the first group may be sequentially outputted in the order of C, D, A, and B from the first frame to the fourth frame, and in the fifth frame, the FRC pattern may be jumped, e.g., the "D" FRC pattern instead of the "C" FRC pattern may be outputted. Also, the FRC patterns (FRC Group 2) of the second group may be sequentially outputted in the order of C, D, A, and B from the second frame to the fifth frame, and in a sixth frame (not shown), the FRC pattern may be jumped, e.g., the "D" FRC pattern instead of the "C" FRC pattern may be outputted. That is, the FRC pattern of the second group may be outputted with one frame difference between the first and second groups. To provide an additional description, FRC patterns outputted during the same frame in two adjacent groups may differ.

Moreover, the polarity patterns (POL Group 1) of the first group may be outputted as "a" and "a" in the first frame and the second frame, and may be outputted as "b" and "b" in the second frame and the third frame. Also, the polarity patterns (POL Group 2) of the second group may be outputted as "b" and "b" in the second frame and the third frame, and may be outputted as "a" and "a" in the fourth frame and the fifth frame. That is, the polarity pattern of the second group may be outputted with one frame difference between the first and second groups. To provide an additional description, polarity patterns outputted during the same frame in two adjacent groups may differ or may be the same.

TABLE 3

| 1) panel polarity: 2-frame jumping | |
|---|---|
| group 1: | a → a → b → b → a → a → b → b → . . . |
| group 2: | a → b → b → a → a → b → b → a → . . . |
| **2) FRC pattern: 4-frame jumping** | |
| group 1: | C → D → A → B → D → A → B → C → . . . |
| group 2: | A → C → D → A → B → D → A → B → . . . |

An example characteristic of each of the FRC patterns and the polarity patterns in the first and second groups is shown in the Table 3 example above.

The number of lengthwise lines of the FRC patterns included in one group may be four.

A reason that the number of lengthwise lines of the FRC patterns included in one group is four is because the FRC pattern may be repeated at four-line intervals in a vertical direction of the panel. Therefore, as the number of lengthwise lines of the FRC pattern is changed, the number of lengthwise lines of one group may be changed. Hereinafter, for convenience of description, an example in which the number of lengthwise lines of the FRC pattern is four will be described.

In the above-described configuration, a jumping period of each of the FRC pattern and polarity pattern in the first group and a jumping period of each of the FRC pattern and polarity pattern in the second group may be set such as that described above in the first and second methods, when the polarity pattern (POL PT) is changed at 2n-frame intervals, the FRC pattern is jumped at 2n×2m-frame intervals. Here, n is a natural number equal to or greater than one, and m is a natural number equal to or greater than one.

As described above, in embodiments, a reason that two or more groups may be provided at the upper portion and lower portion of the panel is for reducing flickers of the panel caused by a periodic change of the polarity pattern.

That is, when an entirety of the panel is composed of one group and the FRC pattern and the polarity pattern are changed at certain jumping periods, an entirety of the panel may be flickered each time the polarity pattern is changed. However, a plurality of groups may be provided at the upper portion and lower portion of the panel, and may have different jumping periods, thus reducing flickers of the panel.

For example, in FIG. 2, when a frame is changed from the first frame to the second frame, the polarity pattern (POL PT) of the first group may not be changed, and the polarity pattern (POL PT) of the second group may be changed from "a" to "b". Also, when a frame is from the second frame to the third frame, the polarity pattern of the first group may be changed from "a" to "b", and the polarity pattern of the second group may not be changed. Accordingly, a flickering period caused by the change of the polarity pattern may increase, and thus, viewers may not recognize flickers.

Hereinafter, an example in which a polarity bias during accumulated frames is not caused by the LCD device and the driving method thereof according to an embodiment performing the above-described function will be described in detail with reference to FIGS. 3 to 6.

Figure 3:
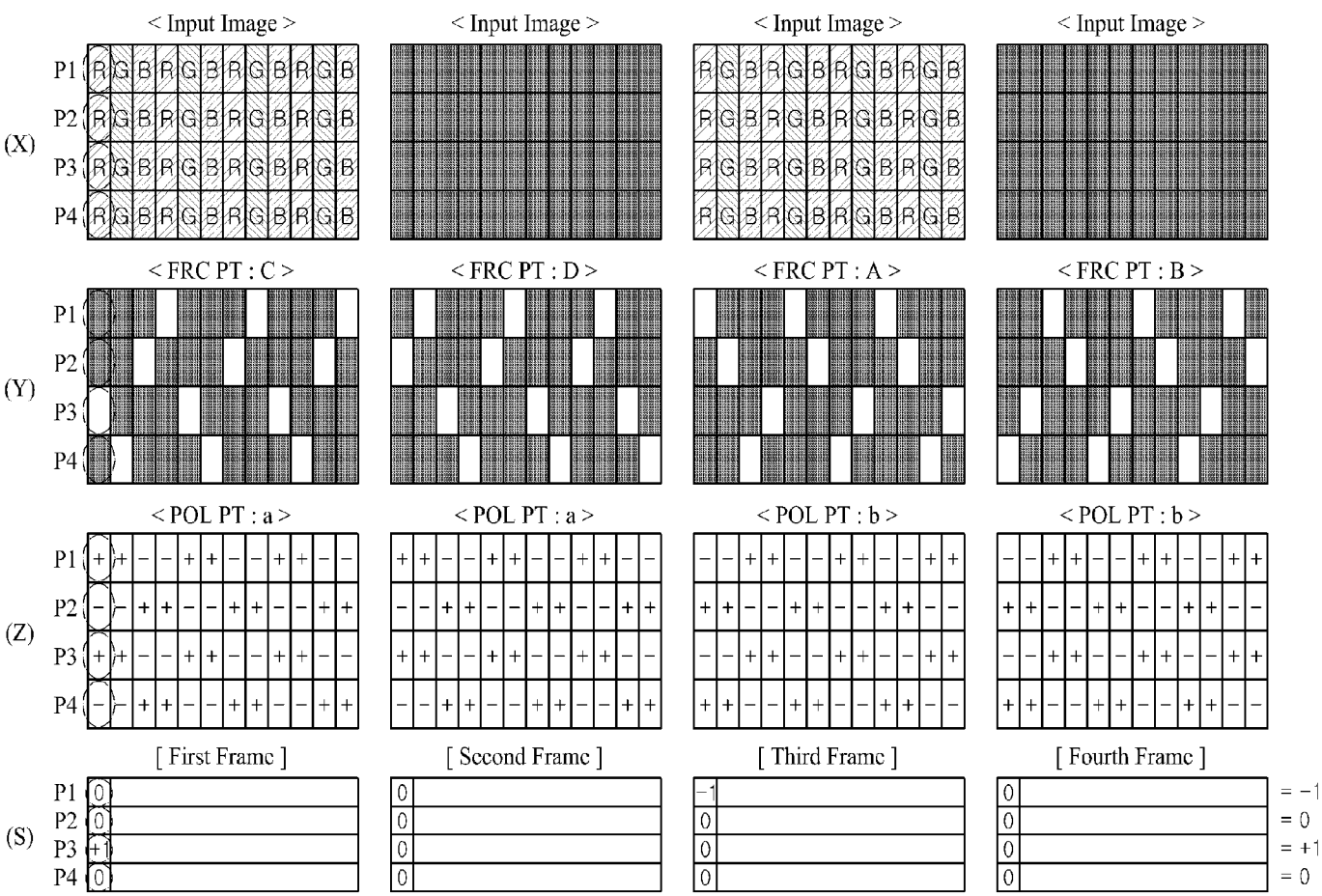
FIGS. 3 to 6 illustrate charts for describing a polarity bias during accumulated frames in the LCD device according to an embodiment.
Figure 4:
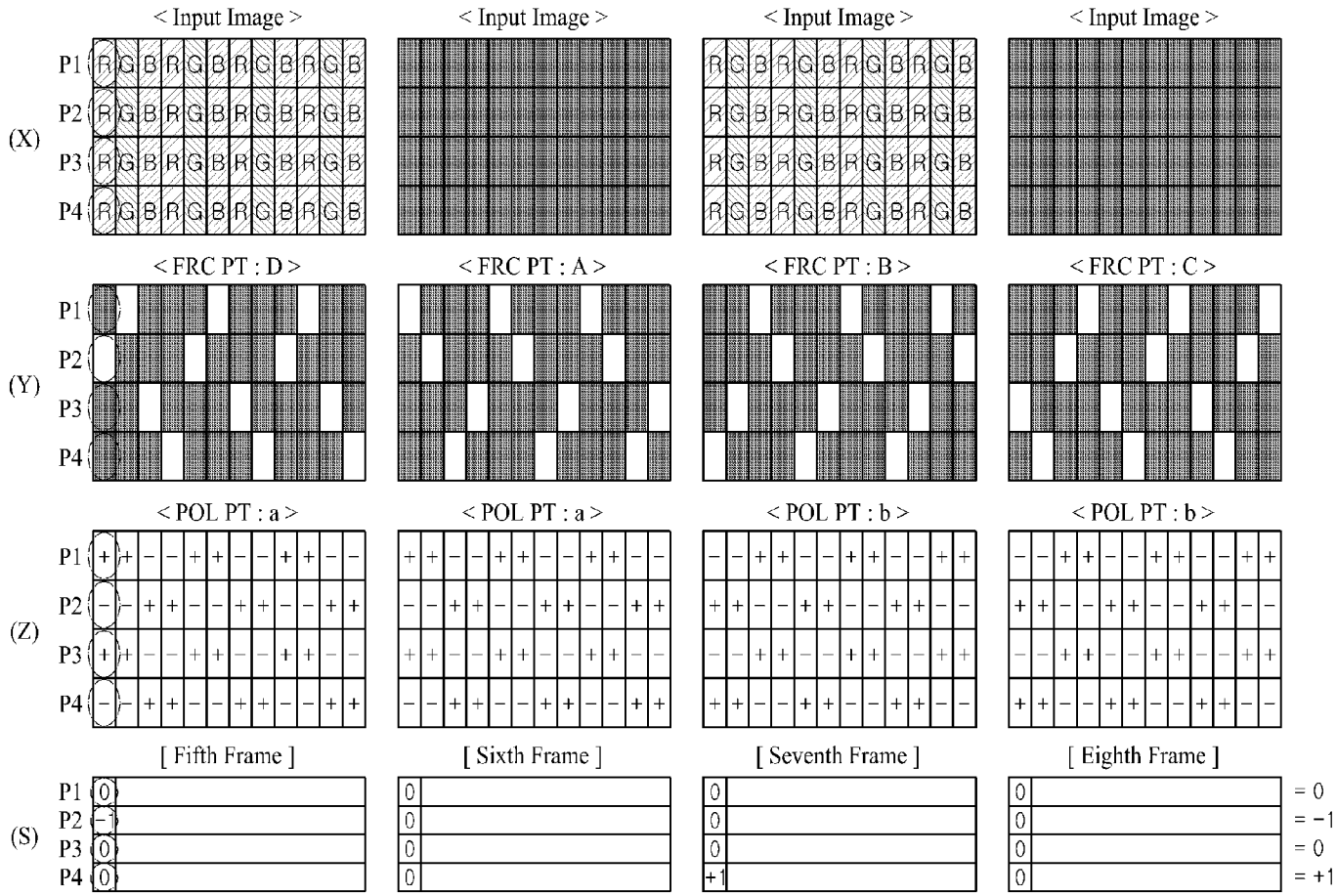
Figure 5:
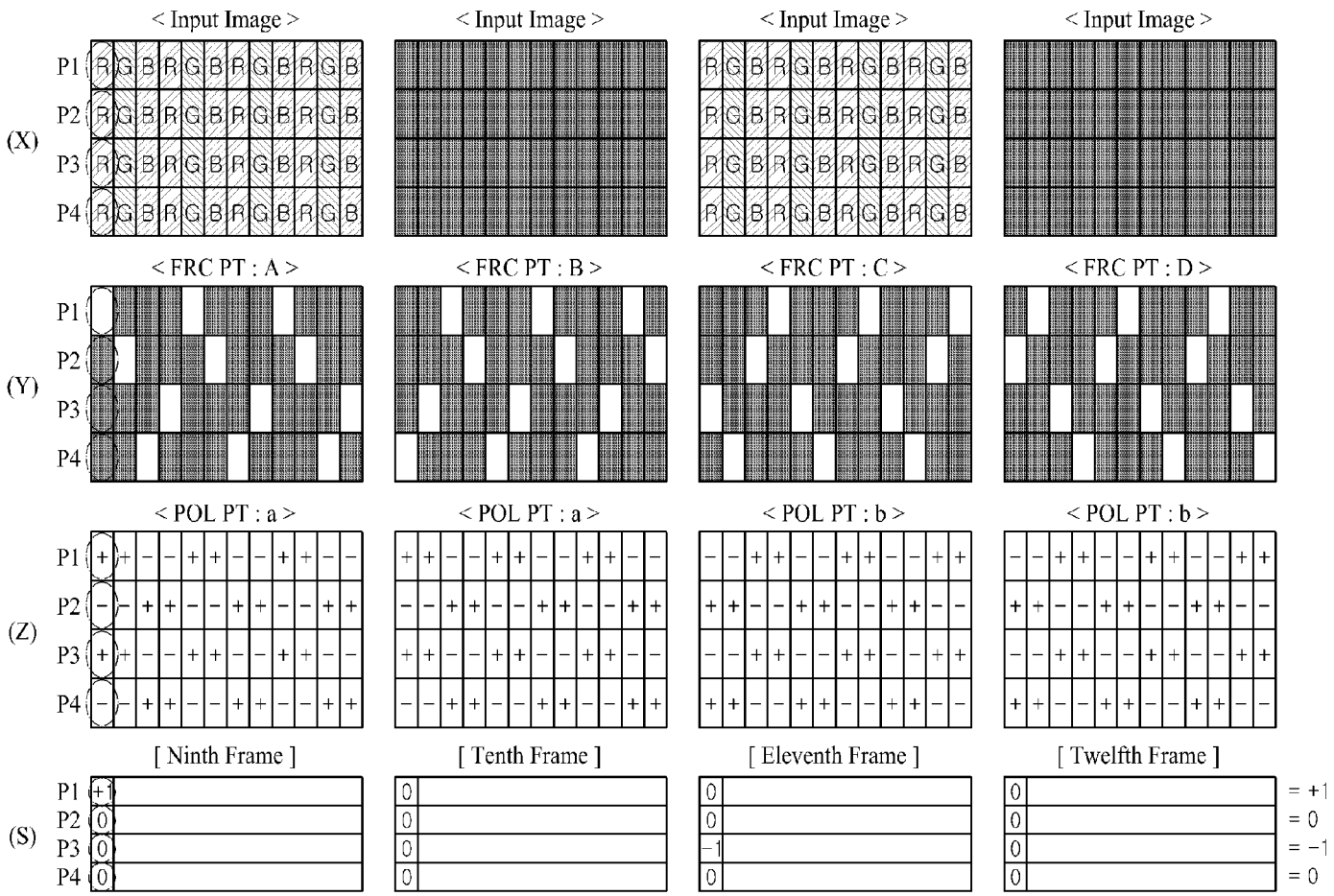
Figure 6:
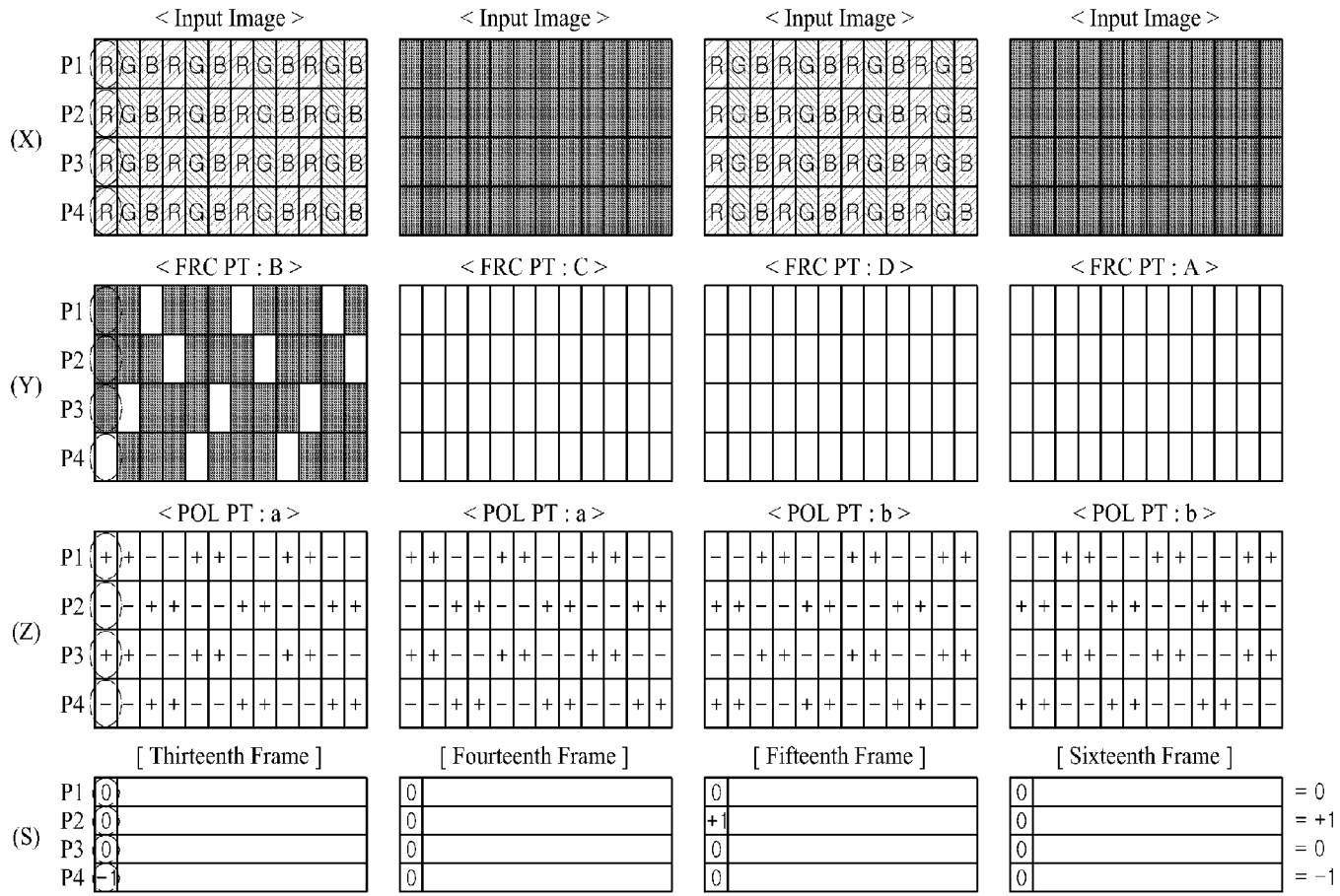

FIGS. 3 to 6 illustrate charts for describing a polarity bias during accumulated frames in the LCD device according to an embodiment. FIG. 3 illustrates the first to fourth frames. FIG. 4 illustrates the fifth to eighth frames. FIG. 5 illustrates the ninth to twelfth frames. FIG. 6 illustrates the thirteenth to sixteenth frames.

Hereinafter, the FRC pattern and polarity pattern included in one of the first and second groups will be described as an example. That is, in FIGS. 3 to 6, although only one group is illustrated, two or more groups may be provided, as illustrated in FIG. 2.

Moreover, for convenience of description, the FRC patterns and polarity patterns illustrated in FIGS. 3 to 6 may be changed and jumped according to the first group shown in FIG. 2 and Table 3. That is, as shown in the first group (Group 1) of Table 3, the FRC patterns illustrated in FIGS. 3 to 6 may be changed in the order of C, D, A, B-(jumping)-D, A, B, C-(jumping)-A, B, C, D-(jumping)-B, C, D, A. As shown in the first group of Table 3, the polarity patterns may also be changed in the order of a, a-(jumping)-b, b-(jumping)-a, a-(jumping)-b, b-(jumping)-a, a-(jumping)-b, b-(jumping)-a, a-(jumping)-b, b.

In FIGS. 3 to 6, a first line (X) indicates input images inputted as first to sixteenth frames in the interlaced mode, a second line (Y) indicates FRC patterns which are repeated at four-frame intervals, and a third line (Z) indicates polarity patterns of the first to sixteenth frames. A fourth line (S) indicates first to fourth pixels P1 to P4 among all pixels of the panel in FIGS. 3 to 6.

A method of calculating a polarity bias in each pixel of the panel may be expressed as the following Equation (4). Equation (4) is the same as Equation (1) described above in the background art. In the following description of example embodiments, a presence of an input image is indicated as "1", a lack of an input image is indicated as "0", black in the FRC pattern is indicated as "0", white in the FRC pattern is indicated as "1", a panel polarity being negative (−) is indicated as "−1", and a panel polarity being positive (+) is indicated as "+1". Equation (4) is as follows:

$$\begin{aligned}\text{polarity} = \quad & (\text{input image of first frame} \times FRC \text{ pattern} \times \text{panel polarity}) + \\ & (\text{input image of second frame} \times FRC \text{ pattern} \times \text{panel polarity}) + \\ & (\text{input image of third frame} \times FRC \text{ pattern} \times \text{panel polarity}) + \\ & (\text{input image of fourth frame} \times FRC \text{ pattern} \times \text{panel polarity})\end{aligned} \tag{4}$$

With reference to the FIG. 3 example, first, in a first pixel P1 of the first frame, an input image is "1", an FRC pattern is "0", and a panel polarity is "+1", and a total polarity value becomes "0". In a second pixel P2 of the first frame, an input image is "0", an FRC pattern is "0", and a panel polarity is "−1", and a total polarity value becomes "0". In a third pixel P3 of the first frame, an input image is "1", an FRC pattern is "1", and a panel polarity is "+1", and a total polarity value becomes "+1". In a fourth pixel P4 of the first frame, an input image is "1", an FRC pattern is "0", and a panel polarity is "−1", and a total polarity value becomes "0".

All polarity values of first to fourth pixels P1 to P4 in the second frame are "0" by using FIG. 3 with the above-described calculation method.

By using FIG. 3 and the above-described calculation method, in a first pixel P1 of the third frame, an input image is "1", an FRC pattern is "1", and a panel polarity is "−1", and a total polarity value becomes "0". In a second pixel P2 of the third frame, an input image is "1", an FRC pattern is "0", and a panel polarity is "+1", and a total polarity value becomes "0". In a third pixel P3 of the third frame, an input image is "1", an FRC pattern is "0", and a panel polarity is "−1", and a total polarity value becomes "0". In a fourth pixel P4 of the third frame, an input image is "1", an FRC pattern is "0", and a panel polarity is "+1", and a total polarity value becomes "0".

All polarity values of first to fourth pixels P1 to P4 in the fourth frame are "0" by using FIG. 3 with the above-described calculation method.

Therefore, when adding the polarity values of the first to fourth frames, an accumulated polarity value of the first pixel P1 is "−1", an accumulated polarity value of the second pixel P2 is "0", an accumulated polarity value of the third pixel P3 is "+1", and an accumulated polarity value of the fourth pixel P4 is "0". That is, a polarity bias occurs in the first to fourth frames.

Referring to FIG. 4, accumulated polarity values of respective pixels from the fifth frame to the eighth frame are 0, −1, 0, and +1. Similarly, a polarity bias also occurs in the fifth to eighth frames.

As shown in FIG. 5, accumulated polarity values of respective pixels from the ninth frame to the twelfth frame are +1, 0, −1, and 0. Similarly, a polarity bias also occurs in the ninth to twelfth frames.

Also as shown in FIG. 5, accumulated polarity values of respective pixels from the thirteenth frame to the sixteenth frame are 0, +1, 0, and −1.

Finally, calculating the accumulated polarity values of the respective pixels from the first frame to the sixteenth frame is as follows.

The accumulated value of the first pixel P1 is: 0 (=(−1) (first frame to fourth frame)+(0) (fifth frame to eighth frame)+(+1) (ninth frame to twelfth frame)+(0) (thirteenth frame to sixteenth frame)).

The accumulated value of the second pixel P2 is: 0 (=(0) (first frame to fourth frame)+(−1) (fifth frame to eighth frame)+(0) (ninth frame to twelfth frame)+(+1) (thirteenth frame to sixteenth frame)).

The accumulated value of the third pixel P3 is: 0 (=(+1) (first frame to fourth frame)+(0) (fifth frame to eighth frame)+(−1) (ninth frame to twelfth frame)+(0) (thirteenth frame to sixteenth frame)).

The accumulated value of the fourth pixel P4 is: 0 (=(0) (first frame to fourth frame)+(+1) (fifth frame to eighth frame)+(0) (ninth frame to twelfth frame)+(−1) (thirteenth frame to sixteenth frame)).

That is, in an embodiment, each of the pixels may have a polarity bias at four-frame intervals, but, as a total of accumulated polarity value during the sixteen frames may be "0", a polarity bias may not occur.

Therefore, as described above, embodiments may overlap and use the polarity patterns and the FRC patterns, and may jump the polarity patterns and the FRC patterns at every predetermined period, thus setting a total accumulated polarity value during the sixteen frames to "0". Accordingly, a polarity bias may not occur in LCD devices using both the interlaced mode and the FRC mode.

Moreover, as described above, embodiments may provide two or more groups in a vertical direction, and may differently set the order of change of the polarity pattern and the order of change of the FRC pattern in each of the groups, thus preventing flickers of the panel.

That is, by providing the polarity pattern, the FRC pattern, and at least two or more groups, embodiments may prevent image sticking caused by a polarity bias in the LCD devices using both the interlaced mode and the FRC mode.

The jumping method described above with reference to FIGS. 3 to 6 is shown in the Table 4 example.

TABLE 4

| Frame | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| Group 1 - FRC pattern | C | D | A | B | D | A | B | C | A | B | C | D | C | C |
| Group 1 - panel polarity | a | a | b | b | a | a | b | b | a | a | b | b | a | a |
| Group 2 - FRC pattern | A | C | D | A | B | D | A | B | C | A | B | C | D | B |
| Group 2 - panel polarity | b | a | a | b | b | a | a | b | b | a | a | b | b | a |

That is, embodiments shown in FIGS. 3 to 6 and Table 4 may jump the polarity pattern (a panel polarity) at two-frame intervals, and may jump the FRC pattern at four-frame intervals.

An object of embodiments for preventing image sticking caused by a polarity bias, as described above, may be achieved by a holding method shown in the Table 5 example, in addition to the method of jumping the polarity pattern and the FRC pattern.

That is, as shown in Table 5, embodiments may hold the FRC pattern at four-frame intervals, and hold the polarity pattern (the panel polarity) at two-frame intervals. To provide an additional description, an embodiment shown in Table 5 may hold the FRC pattern outputted in a fourth frame, thereby allowing the FRC pattern to be continuously outputted even in a fifth frame. In this example, patterns subsequent to the FRC pattern outputted in the fifth frame may be sequentially outputted in a sixth frame.

At this time, the polarity patterns (the panel polarities) may be outputted in the same order as that of the jumping method.

Moreover, a method of holding the FRC pattern and the polarity pattern may also be implemented using at least two groups.

TABLE 5

| Frame | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| Group 1 - FRC pattern | C | D | A | B | B | C | D | A | A | B | C | D | D | A |
| Group 1 - panel polarity | a | a | b | b | a | a | b | b | a | a | b | b | a | a |
| Group 2 - FRC pattern | C | C | D | A | B | B | C | D | A | A | B | C | D | D |
| Group 2 - panel polarity | b | a | a | b | b | a | a | b | b | a | a | b | b | a |

That is, embodiments may use the method of applying the polarity pattern, the method of applying the FRC pattern, the method of providing at least two or more groups, and the jumping method or the holding method, thus preventing image sticking caused by a polarity bias in the LCD devices using both the interlaced mode and the FRC mode.

Hereinafter, for convenience of description, embodiments using the jumping method will be described. However, the following description may be applied to embodiments using the holding method.

Figure 7:
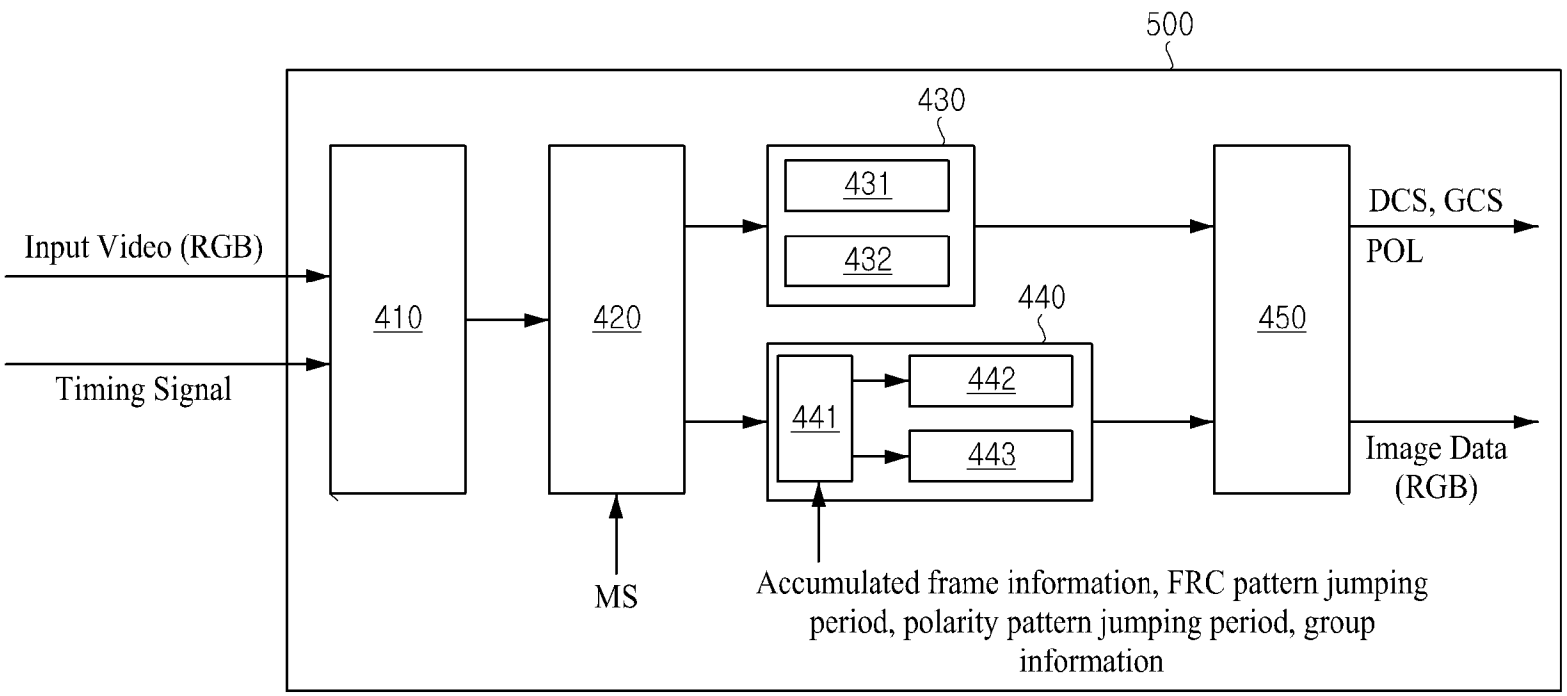
FIG. 7 is a block diagram illustrating an embodiment of an image-sticking removal apparatus applied to the LCD device.
Figure 8:
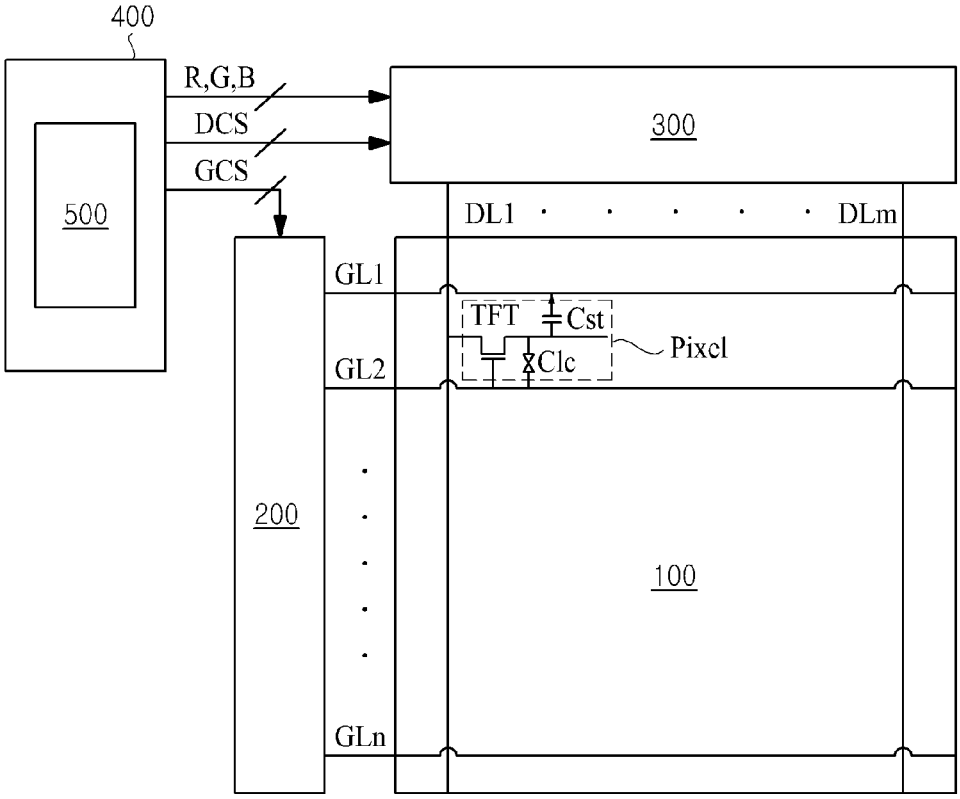
FIG. 8 is a block diagram illustrating an embodiment of the LCD device.
Figure 9:
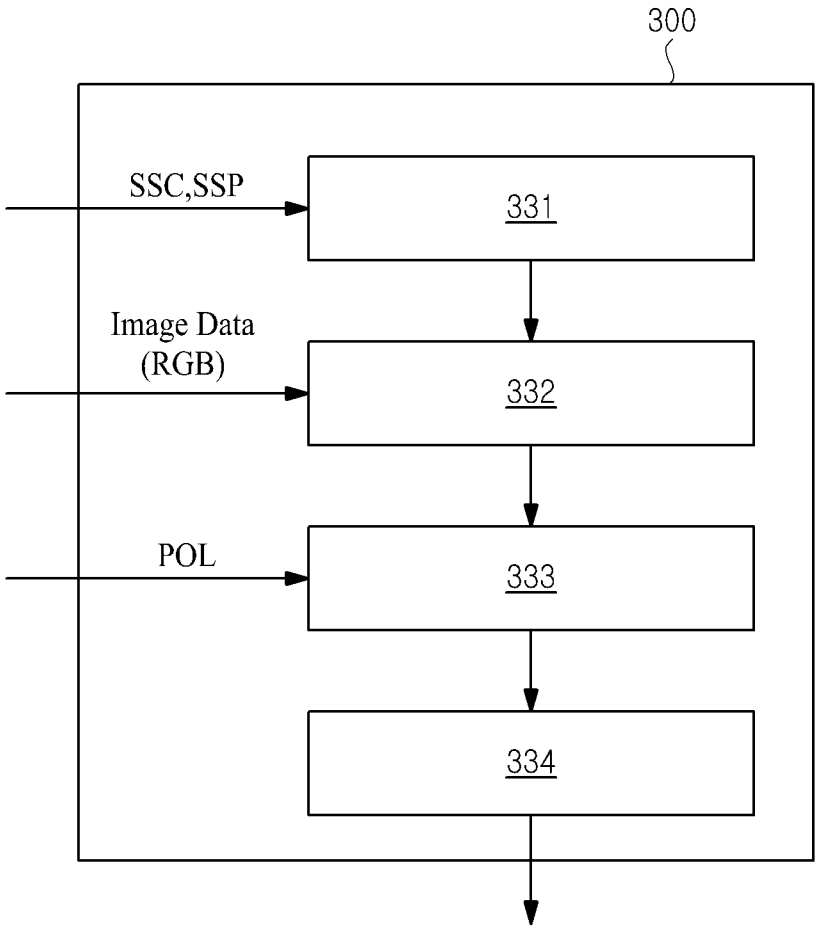
FIG. 9 is a block diagram illustrating an embodiment of a data driver applied to the LCD device.
Figure 10:
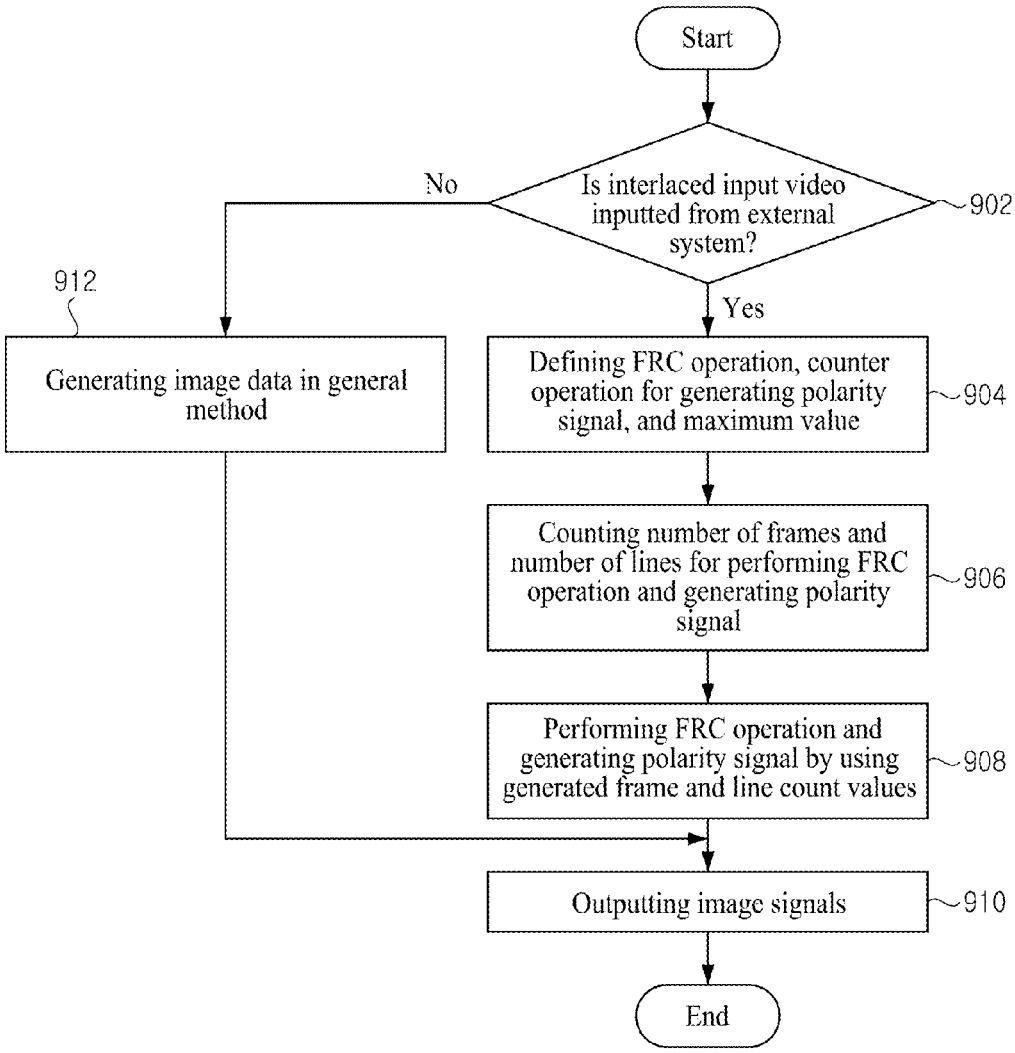
FIG. 10 is a flowchart illustrating an embodiment of a method of driving the LCD device according to an embodiment.

FIG. 7 is a block diagram illustrating an embodiment of an image-sticking removal apparatus applied to the LCD device. FIG. 8 is a block diagram illustrating an embodiment of the LCD device. FIG. 9 is a block diagram illustrating an embodiment of a data driver applied to the LCD device. FIG. 10 is a flowchart illustrating an embodiment of a method of driving the LCD device.

An image-sticking removal apparatus 500 applied to the LCD device, as illustrated in FIG. 7, may include a receiver 410, a selector 420, a general mode driver 430, an image-sticking removal mode driver 440, and a transferor 450.

The receiver 410 may receive input video data (Input Video RGB) and one or more timing signals (Timing Signal) from an external system. The timing signals may include, for example, a vertical sync signal Vsync, a horizontal sync signal Hsync, a data enable signal DE, and a main clock CLK. The receiver 410 may sample the input video data according to a timing of the main clock CLK, and may synchronize the input video data with the external timing signal.

The selector 420 may determine whether to transfer the input video and the timing signals to the general mode driver 430 or the image-sticking removal mode driver 440, in response to a mode selection signal MS inputted from the outside.

When general input video instead of interlaced input video is inputted from the external system, the general mode driver 430 may be selected and driven by the selector 420. That is, when input video that is not based on the interlaced mode is inputted, the general mode driver 430 may be driven, may generate a gate control signal GCS for controlling a gate driver 200 (FIG. 8) and a data control signal DCS for controlling a data driver 300 (FIG. 8), and may align the input video to output aligned image data. That is, the general mode driver 430 is an element which is used for generating a control signal or aligning data in a general timing controller, and includes a control signal generator 431 for generating the control signal and a data aligner 432 that may align the input video to output aligned image data. Thus, a detailed description on this is not provided.

When input video (interlaced input video) to be outputted by the interlaced mode is inputted from the external system, the image-sticking removal driver 440 may be selected and driven by the selector 420. The image-sticking removal mode 440 may receive information on the accumulated frames described above with reference to FIGS. 2 to 6, e.g., information on the jumping period of the FRC pattern, information on the jumping period of the polarity pattern, information on the FRC patterns, and information on the groups. However, the information may be inputted from a memory outside the image-sticking removal apparatus 500, inputted from an internal memory of the image-sticking removal apparatus 500, or stored in the image-sticking removal mode driver 440.

The image-sticking mode driver 440 may include a counter 441 that may count the number of frames, a image sticking-removal control signal generator 442 that may generate an image sticking-removal control signal according to a count value generated by the counter, and an image sticking-removal data aligner 443 that may generate image data according to the count value generated by the counter.

The counter 441 may count a frame period by using one of the vertical sync signal Vsync, the horizontal sync signal Hsync, and the data enable signal DE.

The image sticking-removal control signal generator 412 may generate the gate control signal GCS for driving a gate driver 200 (FIG. 8), and may generate the data control signal DCS for driving a data driver 300 (FIG. 8), according to the count value. For example, the data control signal DCS may include a polarity signal POL that may allow the data driver 300 to output image signals corresponding to the polarity pattern (POL PT) described above with reference to FIGS. 3 to 6.

For example, the image sticking-removal control signal generator 442 may generate the polarity signal POL that may allow the data driver 300 to change a polarity of an image signal outputted to each pixel at two-frame intervals.

The image sticking-removal data aligner 443 may select the FRC patterns (e.g., FRC PT A to FRC PT D) by using information on the count value, the FRC pattern jumping period, and groups, and then may generate and output image data to be transferred to the data driver 300.

That is, the image sticking-removal data aligner 443 may generate image data RGB to be outputted during one frame by using the input images and FRC patterns of FIGS. 3 to 6, and may transfer the image data RGB to the data driver 300.

The transferor 450 may transfer the various control signals DCS and GCS, generated by the general mode driver 430 or the image sticking-removal driver 440, to the gate driver 200, and may transfer the image data RGB, generated by the general mode driver 430 or the image sticking-removal driver 440, to the data driver 300.

The image-sticking removal apparatus 500 may be provided at a main board of the LCD device according to embodiments separately from a timing controller, but as illustrated in FIG. 8, the image-sticking removal apparatus 500 may be built into a timing controller 400 of the LCD device.

The LCD device according to embodiments, as illustrated, may include a panel 100, the timing controller 400, the data driver 300, and the gate driver 200. The image-sticking removal apparatus 500 may be included in the timing controller 400.

First, the panel 100 may include a plurality of pixels that are respectively formed in a plurality of areas defined by intersections between the plurality of gate lines GL1 to GLn and the plurality of data lines DL1 to DLm. Each of the pixels may include a thin film transistor (TFT) and a pixel electrode. The pixel may further include a storage capacitor Cst and a liquid crystal cell Clc, which may be a capacitor.

The TFT may supply an image signal applied through a corresponding data line to the pixel electrode in response to the scan signal being applied through a corresponding gate line. The pixel electrode may drive liquid crystal between the pixel electrode and a common electrode in response to the image signal, thereby adjusting a light transmittance.

The panel of embodiments may be applied to all liquid crystal modes in addition to a twisted nematic (TN) mode, a vertical alignment (VA) mode, an in-plane switching (IPS) mode, and a fringe field switching (FFS) mode. Also, the LCD device according to embodiments may be implemented as a transmissive LCD device, a semi-transmissive LCD device, a reflective LCD device, or the like.

The image-sticking removal apparatus 500 may be configured as illustrated in the FIG. 7 example, and may prevent a polarity bias of the panel 100 by using the principle described above with reference to FIG. 6. The image-sticking removal apparatus 500 may be included in the timing controller 400.

The timing controller 400 may generate the gate control signal GCS for controlling an operation timing of the gate driver 200 and the data control signal DCS for controlling an operation timing of the data driver 300 by using the plurality of timing signals, for example, the vertical sync signal Vsync, the horizontal sync signal Hsync, the data enable signal DE, etc., inputted from the external system. Also, the timing controller 400 may generate image data to be transferred to the data driver 300. That is, the timing controller 400 may be provided separately from the image-sticking removal apparatus 500, and may output a control signal and image data which may be used for a general mode. When the image-sticking removal apparatus 500 is built into the timing controller 400, the timing controller 400 may perform all functions of the image-sticking removal apparatus 500.

The gate driver 200 may sequentially supply a scan signal to the gate lines by using the gate control signals GCS generated by the timing controller 400 or the image-sticking removal apparatus 500. The gate driver 200 may be configured with at least one or more gate driving ICs. That is, the gate driver 200 applied to embodiments may use a gate driver applied to LCD devices of the related art. The gate driver 200 applied to embodiments may be provided independently from the panel 100, and may be configured in a type capable of being electrically connected to the panel 100 in various types. Alternatively, the gate driver 200 may be provided in a gate-in-panel (GIP) type which may be built into the panel 100.

The data driver 300 may be configured with at least one or more source driving ICs. The data driver 300 may convert digital image data transferred from the timing controller 400 into analog image signals, and may supply the image signals for one horizontal line to the data lines at every one horizontal period in which the scan signal is supplied to a corresponding gate line.

That is, the data driver 300 may convert the digital image data into the analog image signals by using gamma voltages supplied from a gamma voltage generator (not shown), and may output the image signals to the respective data lines. As such, as illustrated in the FIG. 9 example, the data driver 300 may include a shift register 331, a latch 332, a digital-to-analog converter (DAC) 333, and an output buffer 334.

The shift register 331 may generate a sampling signal by using the signals received from the image-sticking removal apparatus 500 or the timing controller 400. The latch 332 may latch the image data Data sequentially received from the image-sticking removal apparatus 500 or the timing controller 400, and may simultaneously output the latched image data to the DAC 330.

The DAC 333 may simultaneously convert the image data, transferred from the latch 332, into positive or negative data voltages, and may output the positive or negative data voltages. For example, the DAC 333 may convert the image data into the positive or negative analog data voltages (image signals) by using the polarity signal POL transferred from the image-sticking removal apparatus 500, and may output the positive or negative data voltages.

For example, the DAC 333 may allow image signals (data voltages), outputted to the panel 100, to have the "a" polarity pattern (POL PT: a) of the portion (Z) of FIG. 3 in the first and second frames according to the polarity signal POL, and may allow the image signals (the data voltages), outputted to the panel 100, to have the "b" polarity pattern (POL PT: b) of the portion (Z) of FIG. 3 in the third and fourth frames according to the polarity signal POL. The output buffer 334 may output the positive or negative data voltages, transferred from the DAC 333, to the respective data lines DL of the panel 100

That is, in the LCD device according to embodiments, when interlaced input video driven by the interlaced mode is received from the external system, image data in which the FRC pattern is added into the input video may be transferred to the data driver 300, and the polarity signal POL for controlling a polarity of each of image signals to be outputted from the data driver 300 may be generated and transferred to the data driver 300.

At this time, image data in which the FRC pattern (FRC PT) may be added by the method of FIGS. 3 to 6 are generated, and the polarity signal that allows the polarity pattern (POL PT) of FIGS. 3 to 6 to be outputted may be generated and transferred to the data driver 300.

The data driver 300 may receive digital image data RGB including the FRC pattern from the timing controller 400 or the image-sticking removal apparatus 500, may convert the digital image data into analog image signals, and may output the image signals to the respective data lines of the panel 100. At this time, the data driver 300 may change a polarity of each of the image signals according to the polarity signal POL to output the polarity-changed image signals.

The above-described configuration of the LCD device according to embodiments will now be summarized.

The LCD device according to embodiments may includes: the panel 100 in which the gate lines and the data lines may be formed; the image-sticking removal apparatus 500 that, when the interlaced input video is received from the external system, may generates an FRC pattern to be added into the input video and a polarity pattern used to output the input video to form one group, and may generate at least two or more the groups formed in parallel to the gate lines during one frame; and the data driver 300 that may convert image data inputted from the image-sticking removal apparatus 500 into data voltages, may invert a polarity of each of the data voltages on the basis of the polarity pattern, and may output the polarity-inverted data voltages to the respective data lines.

The image-sticking removal apparatus 500 may convert the input video on the basis of the FRC pattern to generate the image data, may transfer the image data to the data driver 300, and may generate the polarity signal POL corresponding to the polarity pattern to transfer the polarity signal POL to the data driver.

Moreover, the image-sticking removal apparatus 500 may jump, e.g., skip, a plurality of the FRC patterns to be added into the one group at predetermined-frame intervals to generate the image data, may transfer the image data to the data driver 300, may generate the polarity signal POL that allows the plurality of FRC patterns (which will be added into the one group) to be jumped at other predetermined-frame intervals, and may transfer the polarity signal POL to the data driver 300.

For example, when the polarity pattern (POL PT) is jumped at 2n-frame intervals, the FRC pattern may be changed at 2n×2m-frame intervals. Here, n is a natural number equal to or greater than one, and m is a natural number equal to or greater than one.

Moreover, when the number of groups is two or more, periods at which the FRC pattern and the polarity pattern are jumped may be the same for each of the groups, and the FRC patterns which are outputted through adjacent groups during one frame may differ.

Moreover, as described above with reference to FIGS. 3 to 6, the number of FRC patterns included in the one group may be four, and the number of polarity patterns included in the one group may be two. When the FRC patterns are jumped at four-frame intervals and the polarity patterns are jumped at two-frame intervals, an accumulated polarity value of the pixels formed at the panel may become "0" at sixteen-frame intervals.

A method of driving the LCD device according to embodiments will now be described in detail with reference to FIG. 10.

In a first process, when the interlaced input video is received from the external system, the image-sticking removal apparatus 500 may generate an FRC pattern to be added into the input video and a polarity pattern used to output the input video to form one group, and may generate at least two or more the groups to be outputted during one frame, may convert the input video on the basis of the FRC pattern to generate image data, may generate the polarity signal POL corresponding to the polarity pattern, and may transfer the image data and the polarity signal POL to the data driver 300 in operations 902 to 908.

The first process may be subdivided as illustrated in FIG. 10.

First, the image-sticking removal apparatus 500 may determine whether an interlaced input video is inputted from the external system in operation 902. Such a function may be performed according to the selector 420 receiving the mode selection signal MS. That is, the external system may inform the LCD device of whether to perform a de-interlace operation by using the mode selection signal MS. In response to it being determined in operation 902 that a general input video instead of the interlaced input video is inputted, the image-sticking removal apparatus 500 may generate image data in a general method (912), and may transfer the generated image data to the data driver 300 (910).

Subsequently, the image-sticking removal apparatus 500 may define an FRC operation, a counter operation for generating the polarity signal POL, and the maximum value in operation 904.

That is, the counter 441 may jumps or hold a value which may be counted at every externally-predetermined period, and thus, the image sticking-removal control signal generator 442 or the image-sticking removal aligner 443 may select an FRC pattern and a polarity pattern to be outputted at every frame.

Subsequently, the image-sticking removal apparatus 500 may count the number of frames and the number of lines for performing the FRC operation and generating the polarity signal POL in operation 906. That is, the image-sticking removal apparatus 500 may count the number of frames for jumping the FRC pattern or the polarity pattern, and may count the number of lines for forming a group including a plurality of the polarity patterns at every line.

Finally, the image-sticking removal apparatus 500 may generate the FRC pattern and the polarity pattern by using the frame count value and the line count value (908). The generated image data may then be transferred to the data driver 300 (910).

In a second process, the data driver 300 may receive the image data from the image-sticking removal apparatus 500, may convert the received digital image data into analog data voltages, may invert a polarity of each of the data voltages according to the polarity signal, and may output the polarity-inverted data voltages to the respective data lines of the panel 100 in operation 910. The analog image data transferred from the data driver 300 may be transferred from the image sticking-removal data aligner 443, and may be transferred from the data aligner 432 of the general mode driver 430.

In the first process, the operation that may generate the image data and the polarity signal POL and may transfer the image data and the polarity signal POL to the data driver 300 may include: an operation in which the image-sticking removal apparatus 500 may jumps a plurality of the FRC patterns to be added into the one group at predetermined-frame intervals to generate the image data, and may transfer the image data to the data driver 300; an operation in which the image-sticking removal apparatus 500 may generate the polarity signal POL that may allow the plurality of FRC patterns (which will be added into the one group) to be jumped at other predetermined-frame intervals, and may transfer the polarity signal POL to the data driver 300.

That is, embodiments may group the polarity pattern and the FRC pattern, and a plurality of the groups may be grouped at the same size with respect to a displayed image.

For example, each of the groups may be set to have the arbitrary number of lines (1 to N) in one frame. That is, the number of lines of each group may be changed according to a change of the number of vertical lines in which the FRC pattern is variable.

As described above, embodiments may jump a polarity pattern at predetermined-frame intervals, and may jump an FRC pattern at other predetermined-frame intervals, thus removing image sticking caused by a polarity bias which may occur when the interlaced mode and the FRC mode are simultaneously applied.

Moreover, embodiments may change the order of change of each of the polarity pattern and FRC pattern at every certain period, and thus may prevent a polarity bias of each sub-pixel during accumulated frames. Therefore, embodiments may remove image sticking caused by a polarity bias which may occur when the interlaced mode based on an interlace input and the FRC mode are applied.

Although embodiments have been described with reference to a number of illustrative embodiments thereof, it should be understood that numerous other modifications and embodiments may be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display (LCD) device, comprising:

a panel, comprising:

a plurality of gate lines; and a plurality of data lines;

an image-sticking removal apparatus configured to, when an interlaced input video is received from an external system:

generate a frame rate control (FRC) pattern to be added into the input video and a polarity pattern used to output the input video to form one group; and generate at least two or more the groups formed in parallel to the gate lines during one frame; and a data driver configured to:

convert image data inputted from the image-sticking removal apparatus into data voltages;

invert a polarity of each of the data voltages on the basis of the polarity pattern; and output the polarity-inverted data voltages to the respective data lines, wherein:

the image-sticking removal apparatus is further configured to:

jump or hold a plurality of the FRC patterns to be added into the one group at predetermined-frame intervals to generate the image data, and transfer the image data to the data driver, and the image-sticking removal apparatus is further configured to:

generate a polarity signal that allows the plurality of patterns, which will be added into the one group, to be jumped or held at other predetermined-frame intervals, and transfer the polarity signal to the data driver.

2. The LCD device of claim 1, wherein:

the image-sticking removal apparatus is further configured to:

convert the input video on the basis of the FRC pattern to generate the image data; and transfer the image data to the data driver; and the image-sticking removal apparatus is further configured to generate a polarity signal corresponding to the polarity pattern to transfer the polarity signal to the data driver.

3. The LCD device of claim 1, wherein, in response to the polarity pattern being jumped or held at 2n-frame intervals, the FRC pattern is changed at 2n×2m-frame intervals, n being a natural number equal to or greater than one, m being a natural number equal to or greater than one.

4. The LCD device of claim 1, wherein, in response to a number of groups being two or more:

periods at which the FRC pattern and the polarity pattern are jumped or held are the same for each of the groups; and the FRC patterns that are outputted through adjacent groups during one frame differ.

5. The LCD device of claim 1, wherein a number of lines of the FRC patterns to be added into the one group is four.

6. The LCD device of claim 1, wherein, in response to the number of FRC patterns in the one group being four, the number of polarity patterns in the one group being two, the FRC patterns being jumped or held at four-frame intervals, and the polarity patterns being jumped or held at two-frame intervals, an accumulated polarity value of a plurality of pixels formed at the panel becomes 0 at sixteen-frame intervals.

7. A method of driving a liquid crystal display (LCD) device, the method comprising:

in response to an interlaced input video being received from an external system, by an image-sticking removal apparatus:

generating a frame rate control (FRC) pattern to be added into the input video and a polarity pattern used to output the input video to form one group; and generating at least two or more groups formed in parallel to gate lines of a panel during one frame;

converting, by the image-sticking removal apparatus, the input video based on the FRC pattern to generate the image data;

generating, by the image-sticking removal apparatus, a polarity signal corresponding to the polarity pattern;

transferring, by the image-sticking removal apparatus, the image data and the polarity signal to a data driver;

converting, by the data driver, the image data into data voltages;

inverting, by the data driver, a polarity of each of the data voltages according to the polarity signal; and outputting, by the data driver, the polarity-inverted data voltages to respective data lines of the panel, wherein the generating a polarity signal comprises:

jumping or holding, by the image-sticking removal apparatus, a plurality of the FRC patterns to be added into the one group at predetermined-frame intervals to generate the image data, transferring, by the image-sticking removal apparatus, the image data to the data driver, generating, by the image-sticking removal apparatus, a polarity signal that allows the plurality of patterns, which will be added into the one group, to be jumped or held at other predetermined-frame intervals, and transferring, by the image-sticking removal apparatus, the polarity signal to the data driver.

8. The method of claim 7, wherein, in response to the polarity pattern in each of the groups being jumped or held at 2n-frame intervals, the FRC pattern in each of the groups is changed at 2n×2m-frame intervals, n being a natural number equal to or greater than one, m being a natural number equal to or greater than one.

9. The method of claim 7, wherein, in response to a number of groups being two or more:

periods at which the FRC pattern and the polarity pattern are jumped or held are the same for each of the groups; and the FRC patterns that are outputted through adjacent groups during one frame differ.

10. The method of claim 7, wherein a number of lines of the FRC patterns to be added into the one group is four.

11. The method of claim 7, wherein, in response to the number of FRC patterns in the one group being four, the number of polarity patterns in the one group being two, the FRC patterns being jumped or held at four-frame intervals, and the polarity patterns being jumped or held at two-frame intervals, an accumulated polarity value of a plurality of pixels formed at the panel becomes 0 at sixteen-frame intervals.

* * * * *